United States Patent [19]

Maschler et al.

[11] 4,328,087

[45] May 4, 1982

[54] APPARATUS FOR TREATING PORTIONS OF ARTICLES IN A LIQUID

[75] Inventors: Francis S. Maschler, Kansas City; Gary A. Seifert, Lee's Summit, both of Mo.

[73] Assignee: Western Electric Co., Inc., New York, N.Y.

[21] Appl. No.: 209,077

[22] Filed: Nov. 21, 1980

[51] Int. Cl.[3] ..... C25D 17/06

[52] U.S. Cl. ..... 204/297 W; 204/224 R

[58] Field of Search ..... 204/297 W, 224 R, 15, 204/23

[56] References Cited

U.S. PATENT DOCUMENTS 3,634,044 1/1972 Parker ..... 148/6.3

FOREIGN PATENT DOCUMENTS 423442 2/1935 United Kingdom ..... 204/23

1204956 9/1970 United Kingdom ..... 204/224 R

*Primary Examiner*—T. M. Tufariello

*Attorney, Agent, or Firm*—W. O. Schellin

[57] ABSTRACT

Articles 12 are mounted in a holder 24 and the holder is floatingly supported on a liquid 16 such that only portions 53 of the articles 12 to be treated in the liquid 16 become immersed to a predetermined depth therein. The relative position of the holder 24 with respect to the surface 14 of the liquid remains constant, even though the level of the liquid may change with respect to a tank which holds the liquid. A substantially self-supporting electrical conductor 45 mounted to fixed external structures and tied to the floating holder couples the articles 12 into an electrolytic treating circuit 56 without noticeably changing the immersion depth of the articles. The floating support frame 11 of the holder 24 also includes buoyant blocks 41 which are adjustably mounted with respect to a rigid support structure 17. A lateral shifting of the blocks 41 with respect to the structure adjusts the orientation of the frame 11 and the holder 24 with respect to the surface of the liquid.

7 Claims, 4 Drawing Figures

APPARATUS FOR TREATING PORTIONS OF ARTICLES IN A LIQUID

FIELD OF THE INVENTION

This invention relates to treating portions of articles in a liquid. Particularly, the invention relates to suspending articles above the surface of a liquid, such that end portions of such articles depend into the liquid by a predetermined amount. Only those portions of the articles which become exposed to the liquid are treated.

BACKGROUND OF THE INVENTION

Selectively treating portions of articles by exposure to a treating medium frequently requires masking the remaining portions of such articles. One of the exceptions to a requirement for masking articles prior to treating portions thereof is a treatment of end portions of elongate articles in a liquid. Such a treatment is frequently accomplished by suspending the articles to be treated above the surface of the liquid, such that only the end portions of the articles to be treated depend into the liquid.

When such a partial immersion of articles is used to treat predetermined portions of the articles, it becomes important to precisely control the immersion depth of the articles. In open vessels or tanks containing a stagnant liquid at a fixed level, articles are readily immersed into the liquid to a predetermined depth. A structure for supporting the articles relative to the liquid level is typically mounted in fixed relationship to the walls of the tank. Thus by adjusting the height of the articles and the liquid level with respect to the tank, the immersion depth of the articles is established.

When the treating liquid is not stagnant, as, for example, in an electroplating or electro-etching bath, wherein the electrolyte is typically recirculated, the height of a weir between the treating tank and an overflow tank typically establishes the liquid level in the treating tank. Of course, the liquid level resulting from such an overflow across a weir depends to some extent on the flow rate of the liquid removably across the weir.

Thus, when the articles are supported by a structure at a fixed height above the top of the weir, and the flow rate across the weir increases, the liquid level above the weir increases slightly with a related increase in the depth of immersion of the articles into the liquid. In addition to a change in the immersion depth of the articles because the liquid level has changed, the immersion depth sometimes changes only apparently because of ripples occurring on the surface of the liquid.

It is, therefore, desirable to provide a support for partially immersing articles into a liquid, such that the immersion depth of the articles is precisely controlled.

SUMMARY OF THE INVENTION

We have found that an article or even a plurality of articles can be supported with respect to the surface of a treating liquid, such that end portions of such articles extend into the liquid without a need for establishing the surface of the treating liquid at a predetermined level with respect to the tank which contains the liquid.

In accordance with this invention, an article holder grasps the article, such that the portion of the article which is to be treated extends from the holder. A frame which is capable of floating on the surface of the treating liquid removably supports and orients the article holder with respect to the surface of the liquid, such that the portion of the article to be treated extends to a predetermined depth into the liquid.

BRIEF DESCRIPTION OF THE DRAWING

Various features and advantages of the invention will become apparent from the detailed description below, when read in reference to the accompanying drawing, wherein.

DETAILED DESCRIPTION

Figure 1:
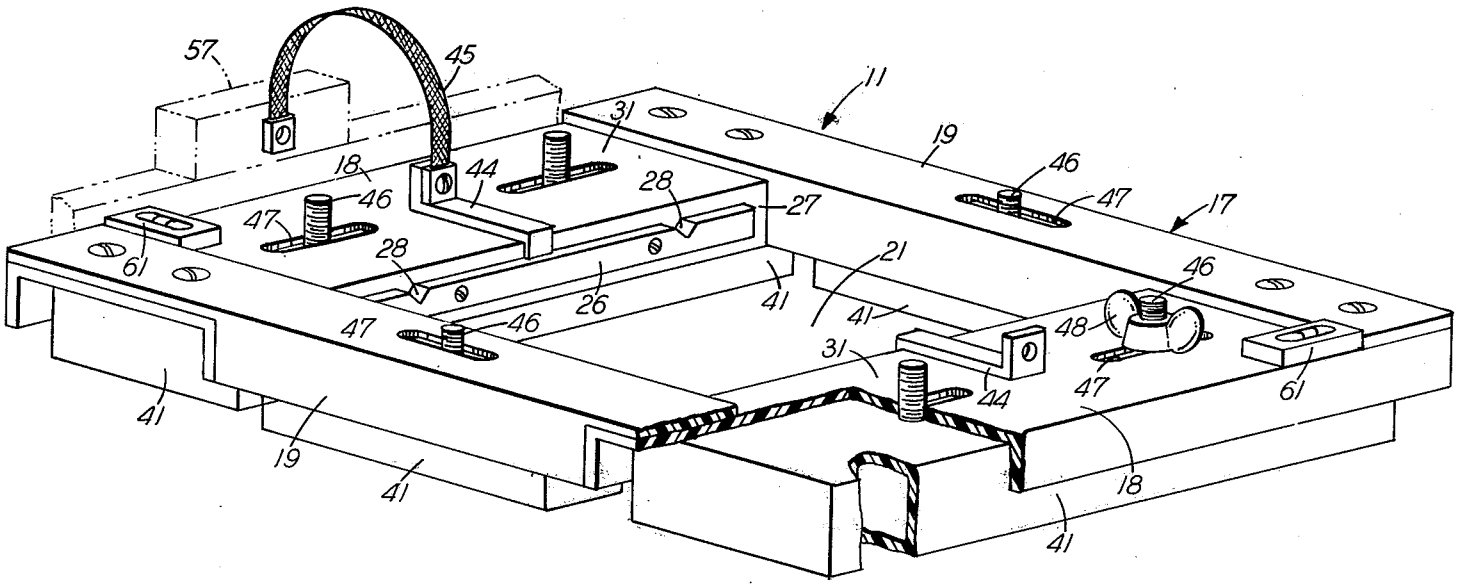
FIG. 1 is a pictorial representation of a floatation frame as one particular embodiment of the present invention.

Referring to FIG. 1, there is shown a frame designated generally by the numeral 11 which represents a particular embodiment of the present invention. The frame 11 is particularly adapted to support one or more articles 12 (see FIG. 2) in an electrolytic process, such as an etching process or a plating process.

Figure 2:
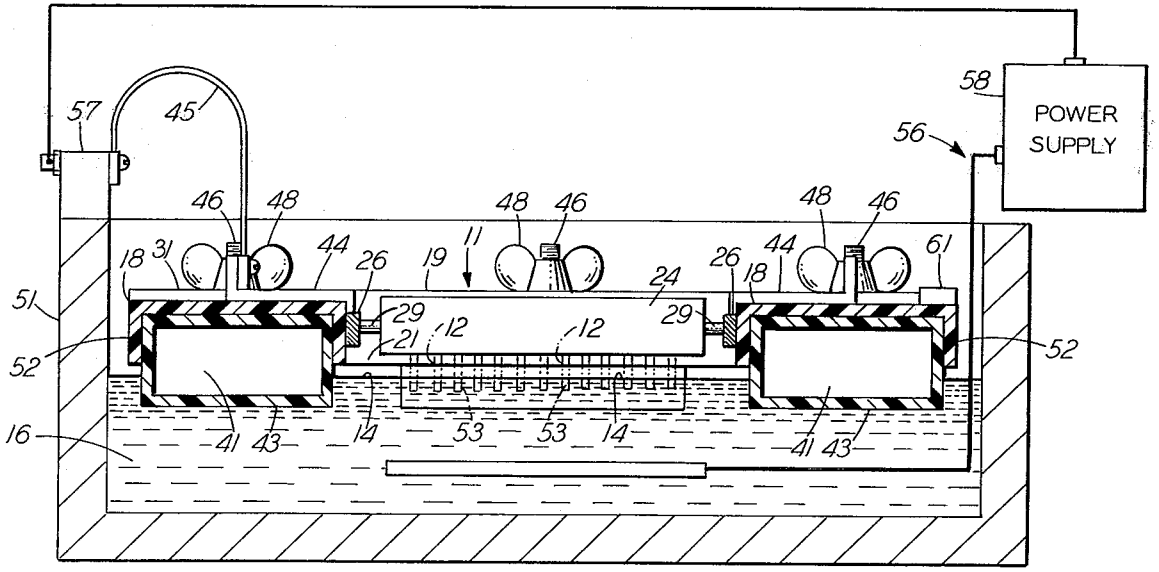
FIG. 2 is a sectional view of the frame of FIG. 1, the frame supporting a rack or holder of articles above a liquid within a treating tank.

As further shown in the sectional view of FIG. 2, the frame 11 provides a buoyant support to such articles 12 in reference to a surface 14 of a liquid 16, which, according to the description of the preferred embodiment, is an electrolytic bath. However, it is to be realized that the liquid need not be an electrolytic bath, such as an etching or a plating bath. Since the present invention is related to a manner of suspending the articles 12 relative to a surface of the liquid 16 rather than to the manner in which the articles are treated, the type of liquid is not of significance, except to the extent that its specific gravity affects the buoyancy of structures intended to float on the surface of the liquid.

Referring again to FIG. 1, the frame 11 in the preferred embodiment is a rigid, rectangular support structure 17 formed of two parallel cross channels 18 which are spaced by two parallel longitudinal channels 19. The longitudinal channels 19 are preferably perpendicular to the cross channels 18. The preferred spacing between each parallel set of channels 18 and 19 is such that a central, rectangular opening 21 is formed between such channels. The opening 21 is preferably of a size to accept the article 12, or, in the particular embodiment shown in FIG. 2, to accept a holder 24 of a plurality of elongate, cylindrical articles 12, which are shown in phantom lines in FIG. 2. A particular holder 24, which is preferably used in conjunction with the frame 17, is described in greater detail including particulars of loading the articles 12 therein in our copending application Ser. No. 209,079 filed Nov. 21, 1981, which is assigned to the assignee of this application. To supplement the teachings of the present invention with the various features and details of the holder disclosed in said copending application and with the particulars of using such a holder, said above application is incorporated herein by reference. However, it must be understood that this invention is not based on the structure of any one particular holder. It may be even preferred in another embodiment to integrate the holder 24 with the structure 17, rather than to have a separate holder; or, the article 12 may be of a shape or size, such that the article 12 is mounted directly on the structure 17 without additional provisions for holding such article.

In further reference to both FIG. 1 and FIG. 2, support rails 26 may be attached to inner flanges 27 of either the longitudinal channels 19 or the cross channels 18. Seats 28 are formed in the rails 26 to receive and locate rod extensions 29 from the holder 24.

Figure 3:
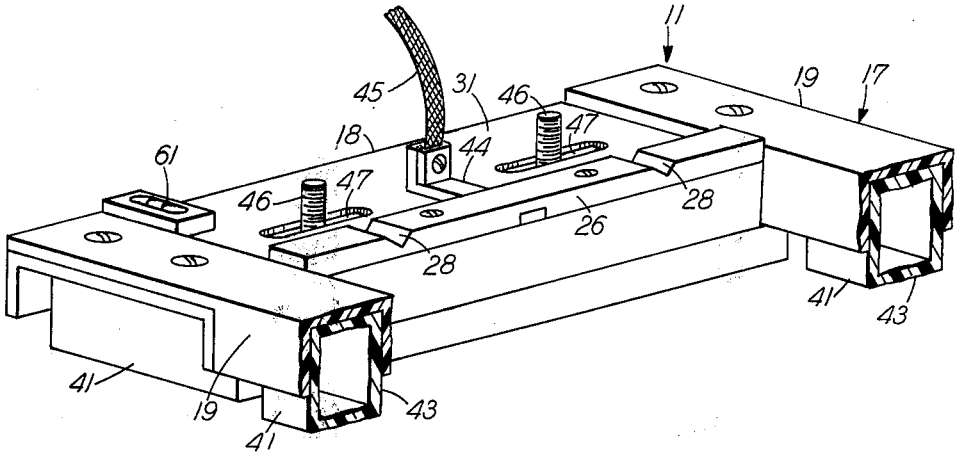
FIG. 3 is a partial view of the frame of FIG. 1, showing an alternate position of positioning rails.

As shown in FIG. 3, an alternate placement of the seats 28 on upper surfaces 31 of, for example, the cross channels 18 is substantially equivalent to the mounting of the rails 26 and seats 28 along the flanges 27 of the channel. The flange mounted rails 26 are, however, in contrast to those mounted on the surfaces 31, vertically adjustable, which may be advantageous, as will be understood from the further description pertaining to the frame 11 and its function.

Since it is contemplated, according to the invention, to floatingly support the frame 11 on the surface 14 of the treating liquid 16, the channels 18 and 19 of the structure 17 are adapted to support and locate buoyancy chambers or blocks 41. The buoyancy blocks 41 are preferably of a plastic material which is not attacked by plating and etching baths which may be used in conjunction herewith. A foamed, closed pore structure is one embodiment for forming the blocks 41 of sufficiently low density to floatingly support the combined weight of the structure 17, the holder 24 and the articles 12 in the holder. A second and preferred embodiment is to form the blocks 41 of a hollow structure of welded or molded walls 43 of a plastic material, such as polyethylene, polypropylene, polyvinyl chloride (PVC) or teflon. Other materials may be available. Criteria for choosing the materials are their inertness to the treating liquid 16, and, of course, the ease of forming the chosen materials into the hollow blocks 41 of desired configurations.

In the preferred embodiment, the channels 18 and 19 are also of a similar plastic material such as polypropylene which is inert to most plating and etching baths. The rails 26 are preferably of stainless steel and are gold plated to offer low resistance electrical contacts, particularly in the area of the seats 28. The rails are preferably electrically coupled through conductive brackets or terminals 44 to conductors 45.

The blocks 41 are preferably equipped with mounting studs 46 or the like, to fasten the blocks 41 to the support structure 17. Preferably, when the blocks 41 are equipped with the mounting studs 46 in an upper surface thereof, the corresponding channels 18 or 19 have receiving apertures 47 through which the studs are inserted, such that the blocks 41 become fastened to the channels with removable fasteners 48 as, for example, wing nuts. In the preferred embodiment, the apertures 47 are slots which permit shifting the blocks 41 along the channels 18 or 19, respectively. Such shifting may be necessary to initially balance the buoyancy of the frame 11 about the center of gravity established by the combined frame 11 and holder 24 including the articles 12. Once the combined structure is balanced, successively loading like holders 24 into the frame 11 does not affect such balance.

FIG. 2 shows, in section, the relationships of the buoyant frame 11, the holder 24 with the representative articles 12 and the surface of the treating liquid 16 in a typical tank 51. Preferably, the widths of the channels 18 and 19 and the blocks 41 are chosen to cover substantially the entire surface 14 of the liquid 16 within the tank 51, except for the opening 21 within the frame 11. As can be seen from FIG. 2, outer flanges 52 of the channels 18 and 19 may be omitted from the structure 17 without any serious decrease in the strength thereof. Without the outer flanges, the channels 18 and 19 become angles, and it is possible to extend the blocks 41 laterally outward beyond the confines of the structure 17.

Whether extending beyond the confines of the structure 17 or mounted beneath the channels 18 and 19 as a preferred embodiment, spreading the buoyancy blocks 41 laterally increases the stability with which the frame 11 floats on the surface of the liquid 16. Thus, the holder 24 is readily balanced within the frame 11 to expose the lower ends 53 of all the articles in the holder 12 equally to the liquid 16.

The floating frame 11 also reduces the open surface area of the liquid 16, or the surface area which interfaces directly with the environmental air. A reduction in the area of such open, liquid-air interface tends to reduce possible evaporation of the liquid and possible heat loss which is typically associated with such evaporation. As a result, the cover offered by the frame tends to stabilize the temperature in the treating liquid. In addition, if noxious fumes are associated with evaporation of the liquid 16, the emission of fumes is also reduced which, in turn, helps to maintain a clean environment.

Another advantage of supporting articles from the floating frame 11 is a reduction in the height of ripples which normally occur at the surface 14 of the liquid 16. Such a reduction is believed to be related to the relatively small, exposed surface area of the liquid within the central opening 21 through which the articles depend into the liquid 16. The ripples typically occur as a natural result of intentional agitation of the fluid to promote a ready and more uniform treatment of the articles 12. However, the ripples also have an unwanted side effect in that the ripples change the height to which the liquid rises along the articles 12, to thereby establish an apparent depth of immersion which differs from the actual depth of immersion of the articles. Thus, a substantial elimination of such surface ripples permits the treated lengths of the articles to substantially correspond to theoretically computed dimensions.

Such theoretical dimensions to which the articles 12 are exposed in the liquid 16 are computed by taking into account the weight of the articles 12, the holder 24 and the combined weight of the support structure 17 and the buoyancy blocks 41. In computing the displacement of the blocks 41, the specific gravity of the treating liquid is, of course, important since the weight of the liquid displaced by the buoyancy blocks 41 equals the weight of the frame 11 including the articles 12, when the frame floats at its predetermined height with respect to the liquid.

Figure 4:
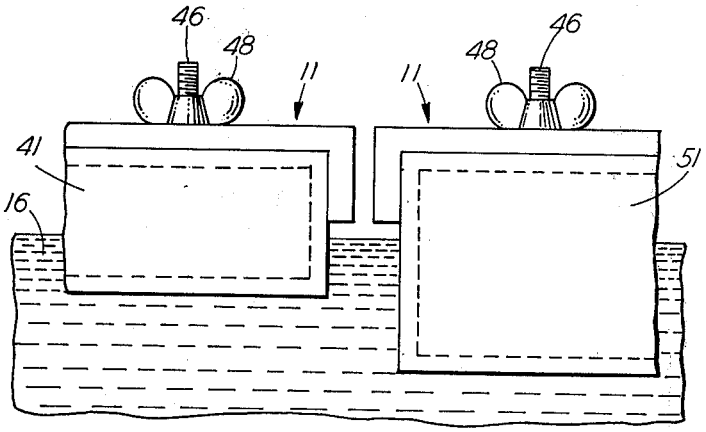
FIG. 4 shows portions of buoyancy blocks for supporting articles and holders of different weights above the surface of the treating liquid.

Depending on the weight and number of the articles 12 and also on the particular structure of the holder 24, the vertical height of the support structure 17 above the surface 14 of the treating liquid 16 can be varied and adjusted by providing buoyancy blocks 41 of different heights. FIG. 4 shows a comparative partial view of two floating frames 11, wherein the frame portion on the left side of FIG. 4 represents the frame 11 supporting relatively light articles in comparison to the frame portion on the right side of FIG. 4. On the right side, buoyancy blocks 54 have a greater height and consequently a greater displacement of the treating liquid than the blocks 41 shown on the left side of FIG. 1. Yet the heights of the structures 17 above the liquid 16 in each case are substantially the same. Thus, it becomes apparent that by changing the blocks 41 on the structure 17 to blocks having different displacements, the frame 11 may readily be adapted to treat articles of different weights.

Further changes in the described structure are possible without departing from the spirit and scope of the invention. For example, the electrical conductor 45 which couples the holder into an electrolytic treating circuit 56 (see FIG. 2) becomes useful only when an electrolytic treating action is desired. The conductor 45 may therefore be deleted in embodiments not relating to electrolytic treating processes. The preferred "U" shape of the conductor 45 is but one embodiment of a substantially self-supporting conductive lead. A pivoted and counterbalanced rigid conductor is an alternative embodiment; however, the structure of the "U"-shaped conductor is preferred because of its simplicity. Thus when the conductor 45 is anchored to an external support 57 or to a power supply 58 of the circuit 56, substantially the entire weight of the conductor 45 is supported by such mounting external to the floating frame 11, and the weight of the conductor 45 contributes little to the displacement of the blocks 41 even when a change in the level of the liquid 16 with respect to the tank 51 takes place.

A further helpful addition to the frame 11 is shown in FIG. 1. Water levels 61 in two horizontal, orthogonal directions may be employed to indicate whether the frame 11 is level and, hence, parallel to the surface of the liquid 16. If, for example, the holder 24 is improperly loaded with the articles 12, at least one of the levels 61 will indicate an imbalance. Since such an imbalance would tend to immerse the articles 12 on one end of the holder 24 to a greater depth into the liquid 16 than on the other end, the articles 12 can either be shifted within the holder 24, or the buoyancy blocks 41 may be shifted to balance the frame 11 with respect to the surface of the liquid.

It is apparent that within the spirit and scope of this invention, the depth of immersion of the articles 12 is a matter of choice. Consequently, the meaning of the term "portion of the article" with respect to its immersion into the liquid should be understood to include any part or all of the article. Thus, with appropriate changes in the holder 24, it is deemed possible to immerse articles 12 entirely.

Changes can also be made in the structure 17 to provide more than one opening 21 in the same frame 11. It should be realized with respect to such an embodiment, however, that the loading of the frame can be caused to be off balance when less than all openings 21 are used in a treating operation. If multiple openings 21 are to be provided in a single tank 51, it is preferred to use more than one frame 11, each frame 11 having one opening 21 for a respective holder 24.

As it must be realized from the above description, various other changes and modifications of the described apparatus are possible without departing from the spirit and scope of this invention.

What is claimed is:

1. Apparatus for supporting at least one article with respect to the surface of a treating liquid which comprises:

a frame bounding a central opening through which said at least one article is mounted to extend with a predetermined portion thereof toward said liquid; and a plurality of buoyancy chambers attached to the frame to become at least partially immersed into the liquid when the frame is placed onto the liquid, such that the frame becomes supported with respect to the liquid by the combined buoyancy of said buoyancy chambers, the buoyancy chambers being slidingly attached for repositioning along the frame such that the center of buoyancy of said apparatus is laterally adjustable with respect to the center of gravity of the apparatus including said at least one article, whereby said buoyancy chambers can be repositioned along the frame to shift the chamber of buoyancy of said apparatus into vertical coincidence with the center of gravity of the apparatus and to orient the frame substantially parallel to the surface of the liquid such that said predetermined portion of said at least one article becomes immersed into said treating liquid.

2. Apparatus according to claim 1, further comprising two water levels mounted to the frame to indicate a level orientation of the frame in two orthogonal directions.

3. Apparatus according to claim 1, wherein said frame is a rectangular frame formed of two sets of spaced, parallel support members, each support member including means for mounting at least one of said buoyancy chambers thereto, and said central opening is a rectangular opening, said frame further comprising support members mounted to the frame at a predetermined height relative to the buoyancy chambers for mounting said at least one article to said frame.

4. Apparatus according to claim 3, wherein said at least one article is a plurality of articles mounted in an array in a holder, said holder having a rectangular configuration to fit within said central opening bounded by said frame, said holder further including means engaging said support members mounted to said frame for positioning said plurality of articles relative to said frames, such that a predetermined portion of each of the articles of said plurality of articles becomes immersed into the liquid, upon mounting said holder including said plurality of articles to said frame.

5. Apparatus according to claim 4, wherein the liquid is an electrolyte and the treatment is an electrolytic treatment, said frame further comprising means for coupling said plurality of articles into an electrolytic treating circuit, said coupling means including a substantially self-supporting electrical conductor rigidly mounted to a mounting bracket not supported by said frame, and extending to an electrical terminal on the frame in a substantially self-supporting span extending from said mounting bracket.

6. Apparatus for supporting a plurality of articles with respect to the surface of an electrolytic treating liquid, such that a predetermined portion of such articles extends into such liquid comprising:

a frame bounding a central opening;

a plurality of buoyancy chambers slidably attached to the frame, said buoyancy chambers to become at least partially immersed into said liquid when the frame is placed onto the liquid, such that the frame is supported at least partially above the liquid by such buoyancy chambers, the positions of such buoyancy chambers being laterally alterable by a sliding adjustment thereof with respect to such frame to alter the horizontal position of the frame with respect to said liquid;

a substantially self-supporting electrical conductor rigidly mounted to a mounting bracket not supported by said frame, and extending from said mounting bracket to an electrical terminal on said frame in a span substantially supported by said mounting bracket;

seats mounted to said frame in a plane at a predetermined distance above the level of the liquid, and electrically coupled to the electrical terminal on said frame; and a holder for mounting the plurality of articles with one end extending therefrom by a predetermined distance, said holder having a size substantially occupying said central opening of said frame and having lateral extensions in a plane and positioned to correspond to the positions of said seats, and having electrical connections between such plurality of articles and said lateral extensions, said holder further having a predetermined weight in conjunction with said articles, such that the holder upon being located on such seats determines the height of said frame with respect to said liquid such that ends of said articles extend to a predetermined depth from said holder into the liquid and electrical continuity exists between the external mounting bracket and the liquid through the plurality of articles.

7. Apparatus according to claim 6, further comprising two water levels mounted to the frame to indicate a level orientation of the frame in two orthogonal directions.

* * * * *